US009820526B2

(12) United States Patent
Poshedley, III

(10) Patent No.: US 9,820,526 B2
(45) Date of Patent: Nov. 21, 2017

(54) FOOTWEAR COVER SYSTEM

(71) Applicant: Martin Paul Poshedley, III, Parma, OH (US)

(72) Inventor: Martin Paul Poshedley, III, Parma, OH (US)

( * ) Notice: Subject to any disclaimer, the term of this patent is extended or adjusted under 35 U.S.C. 154(b) by 1 day.

(21) Appl. No.: 14/665,699

(22) Filed: Mar. 23, 2015

(65) Prior Publication Data

US 2016/0278472 A1 Sep. 29, 2016

(51) Int. Cl.

| | |
|---|---|
| ***A43B 3/16*** | (2006.01) |
| ***A43B 3/20*** | (2006.01) |
| *A43B 3/00* | (2006.01) |
| *A43B 7/12* | (2006.01) |

(52) U.S. Cl.

CPC ..... *A43B 3/16* (2013.01); *A43B 3/166* (2013.01); *A43B 3/20* (2013.01); *A43B 3/0031* (2013.01); *A43B 7/12* (2013.01)

(58) Field of Classification Search

CPC .. A43B 3/20; A43B 3/16; A43B 3/163; A43B 3/166; A41D 17/00; A41D 17/005; A41D 17/02; A41D 17/04

See application file for complete search history.

(56) References Cited

U.S. PATENT DOCUMENTS 228,769 A * 6/1880 Mayall ..... A43B 3/16 36/58.5
1,603,923 A * 10/1926 Powers, Jr. ..... A43B 3/20 206/278
3,325,918 A * 6/1967 Weitzner ..... A43B 3/00 36/1
4,713,895 A * 12/1987 Vallieres ..... A43B 3/24 36/1.5
4,817,306 A * 4/1989 Bayer ..... A43B 3/0031 2/247
5,165,182 A * 11/1992 Michael ..... A43B 3/24 36/1.5
5,337,491 A * 8/1994 Mascotte ..... A43B 3/16 36/7.1 R
5,642,573 A * 7/1997 Brown ..... A41D 17/00 36/132

(Continued)

FOREIGN PATENT DOCUMENTS

CN 203087730 7/2013

*Primary Examiner* — Megan Lynch
(74) *Attorney, Agent, or Firm* — Daniel M. Cohn; Howard M. Cohn

(57) ABSTRACT

A footwear cover system and method to prevent unwanted matter from entering a shoe of a wearer. The footwear cover system includes the shoe having a relatively soft and flexible upper portion for surrounding at least part of the wearer's foot and a sole attached to the upper portion of the shoe. The relatively soft and flexible upper portion has a toe-receiving forepart section, a mid-foot receiving section, and a heel-receiving rear part section. A housing surrounds the shoe and fastens to the shoe at an intersection of the sole and the flexible upper portion. A waterproof rain cover is stored within the housing and adapted to being extended from the housing to enclose the flexible upper portion. A structure is used to secure the waterproof rain cover in place after it has enclosed the flexible upper portion of the shoe.

17 Claims, 4 Drawing Sheets

(56) References Cited

U.S. PATENT DOCUMENTS 5,694,703 A * 12/1997 Diaz ..... A43B 3/163 36/7.1 R
5,694,704 A * 12/1997 Kasbrick ..... A43B 3/16 36/59 R
6,457,260 B1 * 10/2002 Roelofs ..... A41D 17/00 2/23
6,457,266 B1 * 10/2002 Hsiao ..... A43B 3/00 206/216
6,715,220 B1 * 4/2004 Isenberg ..... A43B 1/0036 36/136
6,754,983 B2 * 6/2004 Hatfield ..... A43B 3/163 36/101
7,428,787 B2 9/2008 Crowley, II et al.
2002/0069553 A1 * 6/2002 March ..... A43B 3/163 36/7.1 R
2005/0246921 A1 * 11/2005 Baek ..... A43B 3/163 36/7.1 R
2006/0117598 A1 * 6/2006 Czaplewski ..... A41D 17/00 36/2 R
2008/0005934 A1 * 1/2008 Fernandez ..... A43B 3/0031 36/136
2008/0235993 A1 * 10/2008 Wegner ..... A43B 3/20 36/101
2010/0064551 A1 * 3/2010 Aldridge ..... A41D 17/02 36/2 R
2011/0209358 A1 * 9/2011 Gentry ..... A43B 3/0078 36/7.1 R
2012/0011740 A1 * 1/2012 Kann ..... A43B 3/16 36/7.3
2012/0260536 A1 * 10/2012 Botello ..... A43B 3/16 36/72 R
2013/0047460 A1 * 2/2013 Turner ..... A43B 13/22 36/7.1 R
2014/0096410 A1 * 4/2014 Burkholder ..... A43B 3/16 36/7.1 R
2014/0338225 A1 * 11/2014 Bliss ..... A43C 11/00 36/83
2015/0121727 A1 * 5/2015 Bhagwandeen ..... A43B 3/16 36/72 R
2015/0374063 A1 * 12/2015 Jurgeto ..... A43B 3/20 36/72 R
2016/0106179 A1 * 4/2016 Daye ..... A43B 3/16 36/72 R
2016/0128420 A1 * 5/2016 Troconis ..... A43B 3/248 36/7.1 R

* cited by examiner

FOOTWEAR COVER SYSTEM

FIELD OF THE INVENTION

The present invention relates to a footwear cover system for and more particularly to a housing that surrounds a shoe and fastens to the shoe at an intersection of the sole and the flexible upper portion, and a waterproof rain cover stored within the housing and adapted to being extended from the housing to enclose the shoe.

BACKGROUND OF THE INVENTION

When a person is performing an outdoor activity, in order for safety reasons and in order to realize maximum enjoyment of the activity, it is imperative that his/her footwear be sufficient to provide adequate protection and comfort. A shoe or boot itself is often sufficient to provide adequate protection and comfort to the person; however, there are times when extra protection is required. Mountaineers, hikers, hunters, and outdoor people of many types commonly have problems with moisture and debris getting in their shoes.

Originally, inventors created gaiters as separate devices to be attached to shoes, as needed, in order to keep out moisture. For example, when hiking or maneuvering through a stream or other wet area, a typical shoe or boot will not always prevent water from entering into the shoe or boot, such that the foot of the wearer becomes wet and uncomfortable. There are countless styles and configurations of footwear that are used in all types of climates and for all sorts of activities. In certain conditions it is desirable to have supplemental articles that connect to the footwear. For example, a gaitor (or gaiter) is a detachable covering for use with shoes or other types of footwear. The gaitor can, for example, keep ice, snow, scree or other debris from getting into the interior of the shoe or from covering the laces or other structures for securing the footwear to the foot. However, because gaiters and shoes are separate components, the gaiters must be carried separately in one's hands or some type of separate carry sack when not being used.

SUMMARY OF THE INVENTION

According to an embodiment of the present invention, there is disclosed a footwear cover system to prevent unwanted matter from entering a shoe of a wearer. The footwear cover system includes the shoe having a relatively soft and flexible upper portion for surrounding at least part of the wearer's foot and a sole attached to the upper portion of the shoe. The relatively soft and flexible upper portion has a toe-receiving forepart section, a mid-foot receiving section, and a heel-receiving rear part section. A housing surrounds the shoe and fastens to the shoe at an intersection of the sole and the flexible upper portion. A waterproof rain cover is stored within the housing and adapted to being extended from the housing to enclose the flexible upper portion. A structure is used to secure the waterproof rain cover in place after it has enclosed the flexible upper portion of the shoe.

According to another embodiment of the present invention, there is disclosed a method for preventing unwanted matter from entering a shoe of a wearer. The method includes providing the shoe with a relatively soft and flexible upper portion for surrounding at least part of the wearer's foot and a sole attached to the upper portion of the shoe. The method includes providing the relatively soft and flexible upper portion with a toe-receiving forepart section, a mid-foot receiving section, and a heel-receiving rear part section. Further, the method includes fastening a housing to the shoe at an intersection of the sole and the flexible upper portion, and storing a waterproof rain cover within the housing. The method further includes extending the waterproof rain cover from the housing, thereby enclosing the flexible upper portion. The method also includes securing the waterproof rain cover in place after it has enclosed the flexible upper portion of the shoe.

BRIEF DESCRIPTION OF THE DRAWINGS

The structure, operation, and advantages of the present invention will become further apparent upon consideration of the following description taken in conjunction with the accompanying figures (Figs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity. In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
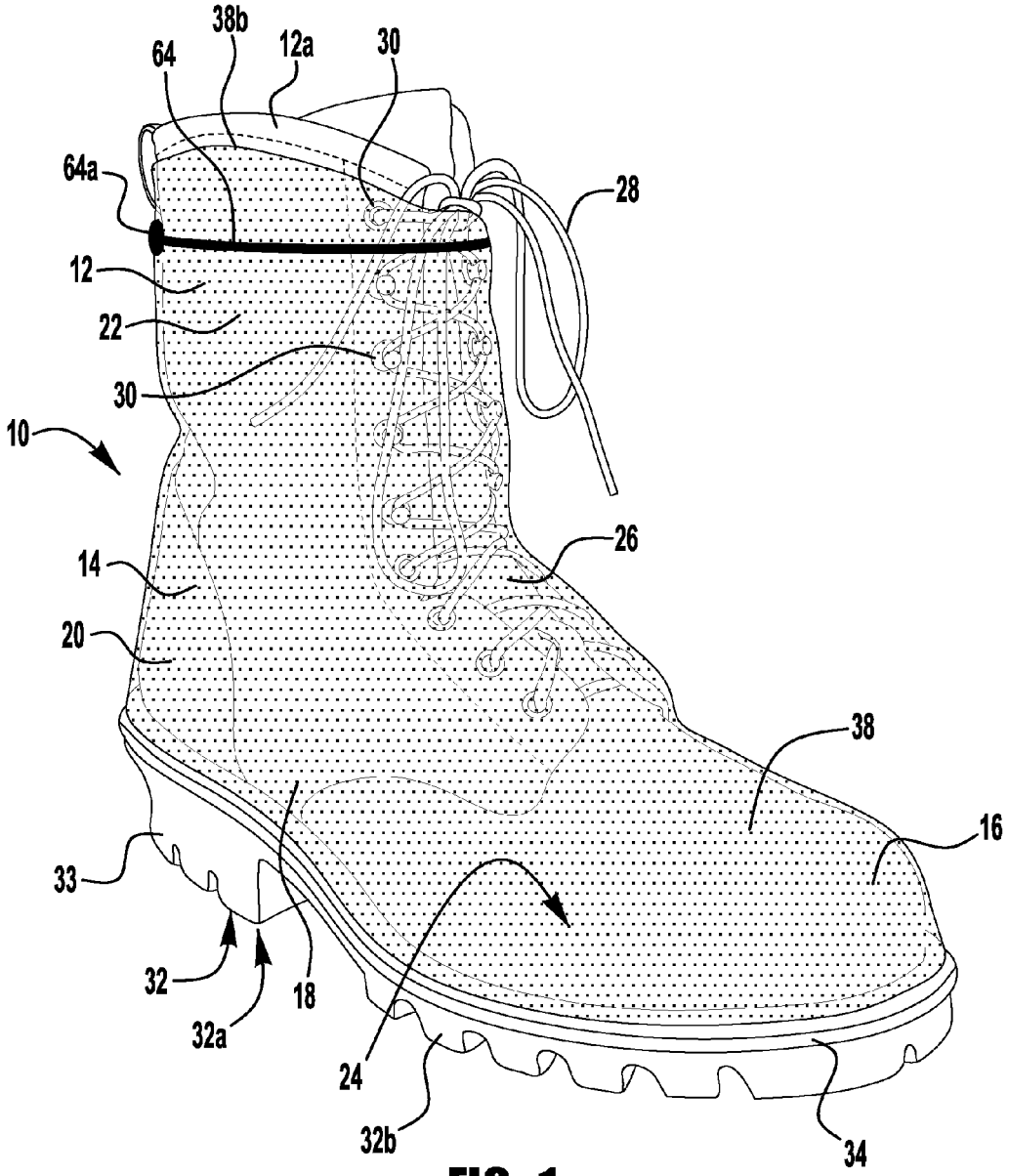
FIG. 1 is a front three dimensional view of the footwear cover system in use with a shoe, in accordance with the present invention.
Figure 2:
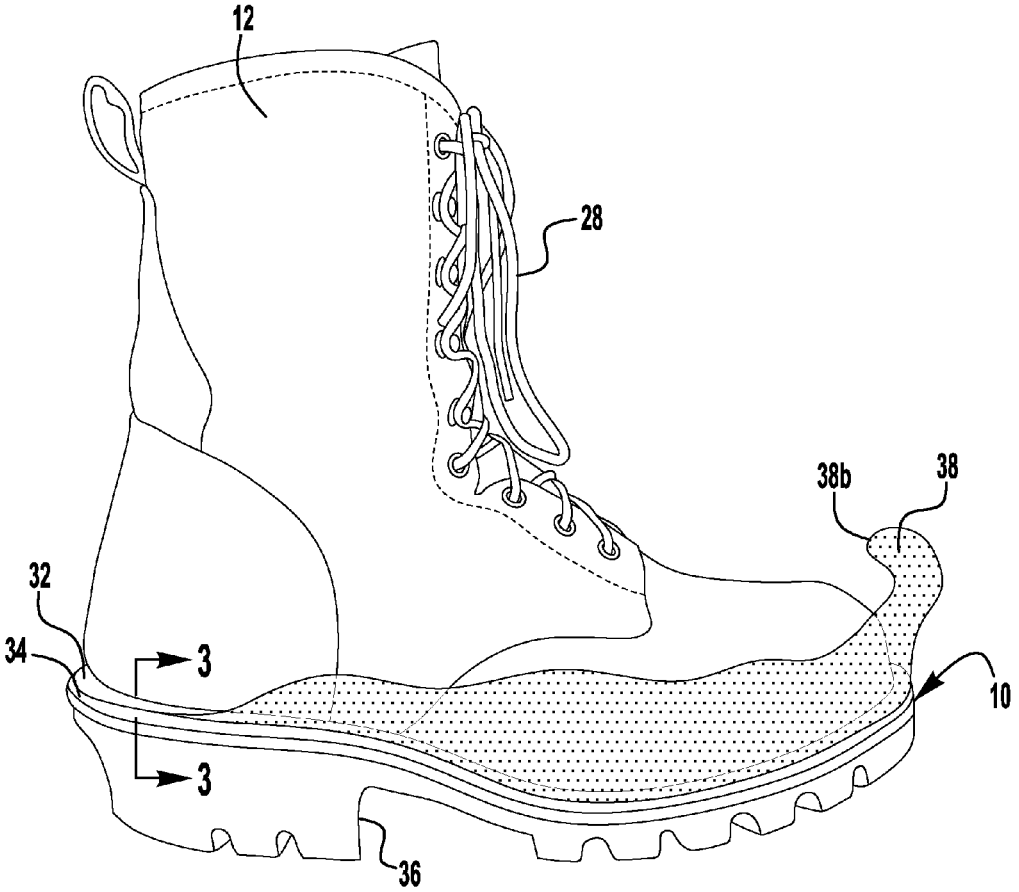
FIG. 2 is a front three dimensional view of the footwear cover system in use with a shoe, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

Most shoes and boots are typically manufactured of leather or textile material. If the material is not specially treated, it will easily allow water to penetrate it. Such penetration causes the shoe upper to become wet, which in turn can cause the wearer's sock and eventually the wearer's foot to become wet. Walking in a wet shoe is not only uncomfortable, it can cause foot ailments such as blisters to occur, as well as foot fungus to develop. These foot ailments can lead to potentially serious health concerns.

The footwear cover system 10 is provided to prevent unwanted matter from entering the shoe or boot, whereby protection and comfort are provided to the wearer during any outdoor activity. The footwear cover system 10 is particularly designed to keep out rain and debris from the upper portion of a boot or shoe, and achieves this end without adding significant weight, and without increasing restriction in use or while putting on or taking off the shoe. The footwear cover system 10 is to be adapted to be a modification to boots or shoes that will prevent moisture, precipitation, dirt, sand and other debris from entering the interior of a shoe or boot.

FIG. 1 illustrates a front, three-dimensional view of the shoe 12. As used herein, the term "shoe" is intended to encompass a variety of footwear including, but not limited to, casual shoes, dress shoes, boots, sneakers, athletic shoes, moccasins, sandals and the like. The footwear cover system 10 designed to be applicable to all types of shoes. While a shoe for the right foot is shown in FIG. 1, it should be understood that a shoe for the left foot would be a mirror image thereof. In general terms, the footwear cover system 10 is a system wherein a waterproof rain cover 38 is stored in a housing 34 that is secured to a shoe 12. When the need arises, such as an unexpected rain shower, the waterproof rain cover 38 may be quickly removed from the housing. The waterproof rain cover 38 is extended from the housing when needed and fastened around the shoe 12, forming a complete closure, to keep out not only moisture, but dirt, rocks, sand, stickers, and various other types of debris possibly encountered while using the shoe. The footwear cover system 10 is not cumbersome to the user if one utilizes the shoe 12 solely as a typical shoe while the waterproof rain cover 38 is stored within the housing. The footwear cover system 10 provides for a shoe 12 which can be used solely as a shoe, with the waterproof rain cover system being inconspicuous, yet ready for use at a moment's notice.

As seen in FIG. 1, the shoe 12 includes a relatively soft and flexible upper portion 14 for surrounding at least part of the wearers foot, including a toe-receiving forepart section 16, a mid-foot receiving section 18, and a heel-receiving rear part section 20. Typically, the shoe includes a pair of side flaps 22 which define an interior foot recess 24, a shoe tongue 26 extending between the shoe side flaps, and a means for securing the shoe side flaps to each other. For example, the means for securing the shoe side flaps to each other will typically utilize laces 28 threaded through a plurality of lace eyelets 30 disposed along parallel, opposing sides of the side flaps 22. However, it is within the terms of the embodiment that other fastening means, such as VELCRO® straps may be used. Attached to the upper portion 14 of the shoe 12 is a sole 32. As seen in FIG. 1, the sole 32 may include a tread 33 on the external bottom 32*a* of the sole.

Typical materials used in the upper portion 14 of the shoe 12 include leather and man-made sheet materials, such as polyvinyl or polyurethane sheets, or a combination thereof. The particular materials used in the upper portion 14 are not critical to the use of the footwear cover system 10. The sole 32 is typically molded or formed from one or more man-made elastomeric materials such as foamed or solid polyurethane or ethylene vinyl acetate, and are configured to include common structural features such as a top or "footbed" surface, a peripheral outer or side wall surface 32*b*, and a bottom or ground contacting surface 32*a*. The sole 32 may be directly attached to the upper portion 14 by sewing, gluing, welding or any other desired method.

As illustrated in FIGS. 1-8 there is a housing 34 that is glued, stitched or otherwise fastened to the shoe 12. Typically, the housing 34 is secured at the intersection of the sole 32 and the flexible upper portion 14 and preferably surrounds the shoe 12 about the sole 32. However, it is within the terms of the embodiment that the housing 34 is secured to the bottom exterior 32*a* of the sole 32, typically adjacent to the heel portion 36 of the shoe 12 (this embodiment not shown). The housing 34 can be at least partially constructed of a stretchable material so that when the waterproof rain cover 38 is stored within the housing 34, the material of the cover is able to stretch or flex, whereby the working volume of the housing is increased, such that storage of the waterproof rain cover 38 within the housing is made easy. Alternatively, the housing 34 can be constructed of a non-stretchable material, so long as the volume of the housing is large enough to adequately store the waterproof rain cover 38.

Figure 3:
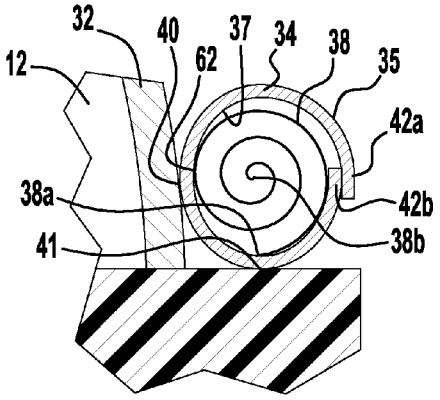
FIG. 3 is a cross sectional view through line 3-3 of FIG. 2.
Figure 5:
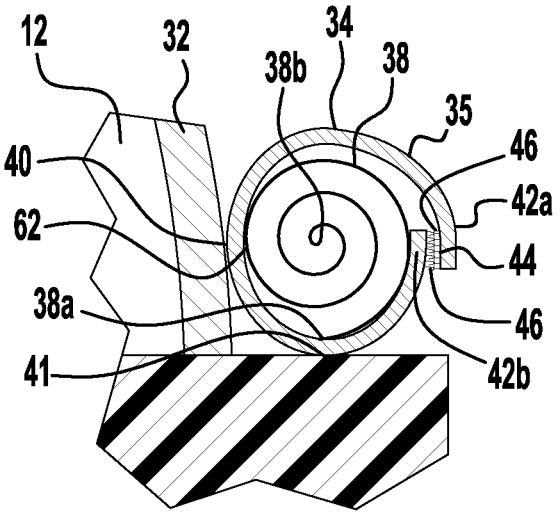
FIG. 5 is a cross sectional view through line 5-5 of FIG. 4.
Figure 7:
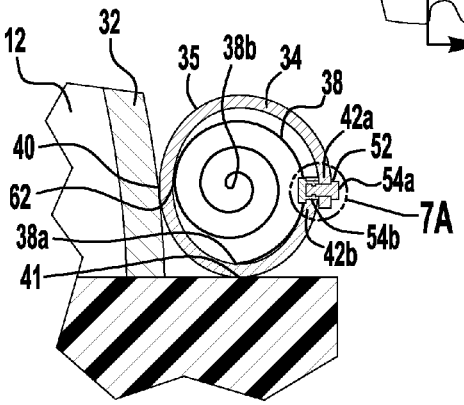
FIG. 7 is a cross sectional view through line 7-7 of FIG. 6.

As illustrated in FIGS. 3, 5, and 7, the housing 34 has an outer surface 35 which is secured at the intersection of the sole 32 and the flexible upper portion 14. An exterior back portion 40 can be secured or attached to the flexible upper portion 14. In addition, an exterior bottom portion 41 can be secured to the sole 32 of the shoe 12. Both the exterior back portion 40 and the exterior bottom portion may be attached with an adhesive, stitched thereto, or any other desired method, either at the time the shoe is produced. Alternatively, the housing 34 may be retrofitted to the shoe at a later time. The housing 34 is typically constructed of a waterproof fabric with first and second ends 42*a* and 42*b*, respectively. First and second ends 42*a* and 42*b* are typically disposed with the outer first end 42*a* covering the inner second end 42*b* at a location opposite from where exterior back portion 40 is attached to the upper portion 14. Having the outer end 42*a* covering the inner end 42*b* tends to prevent debris and moisture from entering the housing and collecting on the waterproof rain cover 38 contained therein.

Figure 4:
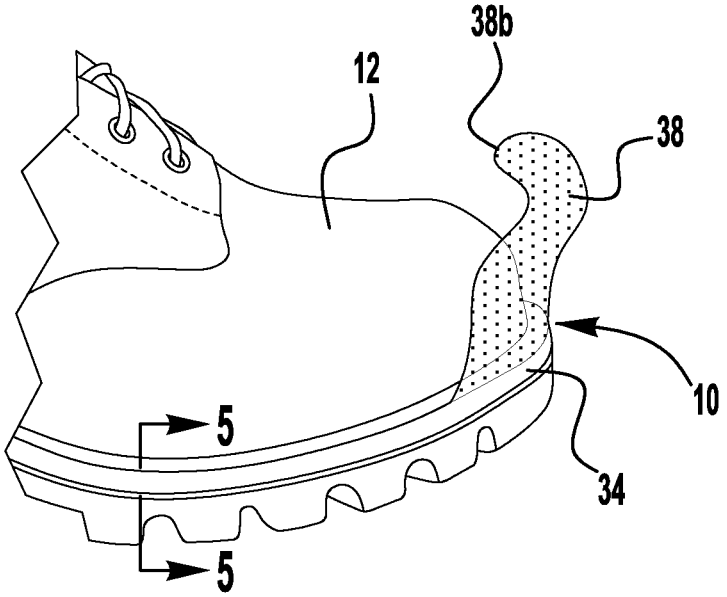
FIG. 4 is a partial side three dimensional view of a second embodiment of the footwear cover system, in use with a shoe, in accordance with the present invention.

When the waterproof rain cover 38 is stored within the housing 34, the first and second ends 42*a* and 42*b* overlap each other and can be secured together by any desired means. In a first embodiment, as seen in FIG. 3 and FIG. 4, first end 42*a* simply extends over second end 42*b*, such that the second end 42*b* tucks under the first end. In this manner, the waterproof rain cover 38 is secured therein. To remove the waterproof rain cover 38, the user simply untucks the second end 42*b* from under the first end 42*a* and removes the waterproof rain cover 38 to cover the shoe 12.

The waterproof rain cover 38 may be fabricated from a wide variety of materials. By way of example only, the waterproof rain cover 38 may comprise leather, mesh, LYCRA® brand spandex synthetic fibers and filaments, nylon (such as ripstop nylon or urethane coated nylon), neoprene, laminated fabric, spandex, waterproof fabrics (such as GORE-TEX® brand waterproof fabrics), or any combination thereof. The waterproof rain cover 38 may also include an insulating material, such as fleece, which may be used alone or in combination with any of the other materials discussed above.

The size, shape and other dimensions of the waterproof rain cover 38 may vary, depending on the desire of the user. The dimensions of the waterproof rain cover 38 must be such that it provides a tight, secure fit around the shoe 12, and/or a portion of the wearer's leg. For example, the waterproof rain cover 38 may extend to the top 12*a* of the shoe 12, or further up the leg of the user. It is within the terms of the embodiment that a picture or logo may be placed on the waterproof rain cover 38.

In a preferred embodiment, a first end 38*a* of the waterproof rain cover 38 is attached to an interior surface 37 of the housing 34. The first end 38*a* can be attached to the interior surface 37 with an adhesive, stitching, a hook and loop fastener system, snaps, buttons, a zipper, or by any other appropriate desired method. The second end 38*b* of the waterproof rain cover 38 is generally within the cover after the cover has been rolled up for placement within the housing 34.

When the second end 38*b* of the waterproof rain cover 38 is pulled out of the cover and pulled up and over the shoe 12, the first end 42*a* remains disposed over the second end 42*b* with the cover therebetween so that the housing 34 does not have a tendency to fill with debris or water when the waterproof rain cover 38 is extended for use. It is further within the terms of the embodiment that the first end 38*a* of the waterproof rain cover 38 can be attached directly to any appropriate location on the shoe 12, with an adhesive, stitching, or any other desired method.

After the waterproof rain cover 38 has been extended upwardly from the housing 34, it is secured about the shoe 12 or the leg of the wearer. Preferably, the waterproof rain cover 38 is provided with a structure to secure the waterproof rain cover after the cover has been disposed in place around the shoe 12 or the wearer's leg. In one embodiment, as seen in FIG. 1, the structure is an elastic loop 64 is provided that is designed to secure the waterproof rain cover 38 about the shoe 12. The elastic loop 64 is attached to the waterproof rain cover 38 and is held thereto at location 64*a*, such as with VELCRO®. When not in use, the elastic loop 64 may simply be rolled into the housing 34 along with the waterproof rain cover 38. It is further with the terms of the embodiment that there be strips of Velcro (not shown) on the interior of the waterproof rain cover 38 that engage strips of Velcro (not shown) on the shoe 12 to further secure the waterproof rain cover.

In an alternative embodiment (not shown), the second top end 38*b* of the waterproof rain cover 38 is provided with a drawstring, the free ends of which are fastened to the waterproof rain cover. When the drawstring is tightened, the second top end 38*b* of the waterproof rain cover 38 is substantially conformed to the shoe 12 or wearer's leg to prevent water and debris from entering therebetween. The drawstring is typically formed of an elastic synthetic material and is provided with a locking or tensioning device thereon secured in position by loop of the drawstring.

In an alternative embodiment (not shown), a cinch member is fastened around the upper portion of the waterproof rain cover 38. When the waterproof rain cover 38 is to fully extend, the top of the waterproof rain cover is cinched, and when the waterproof rain cover is to cover a lesser extent of the user's shoe or leg, the waterproof rain cover is loosened around the top portion, then folded over, and cinched around a central portion.

In a second embodiment, as seen in FIGS. 4 and 5, two portions 44 and 46 of VELCRO® material may be utilized to secure the waterproof rain cover 38 within the housing 34. A loop portion 44 of the VELCRO® material may be disposed along the length of first end 42*a*, which is adapted to connect to a hook portion 46 of the VELCRO® material disposed along the length of the second end 42*b*. To remove the waterproof rain cover 38, the user separates the loop portion 44 of VELCRO® material disposed along the length of the first end 42*a* from the hook portion 46 of VELCRO® material disposed along the length of the second end 42*b* of the housing 34. Then the waterproof rain cover 38 can be pulled out from the housing 34 and disposed around the shoe 12.

Figure 6:
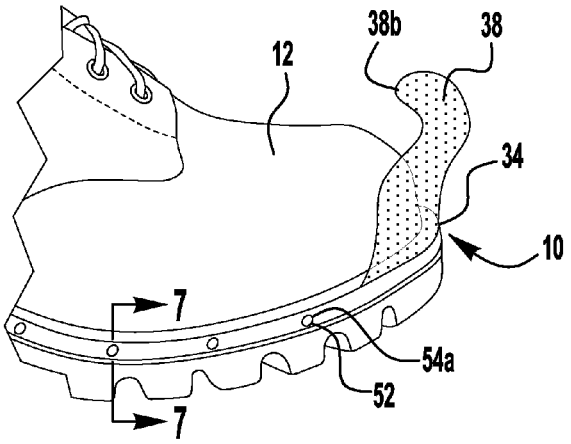
FIG. 6 is a partial side three dimensional view of a third embodiment of the footwear cover system in use with a shoe, in accordance with the present invention.
Figure 7A:
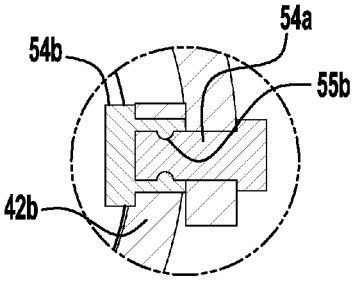
FIG. 7A is an exploded cross sectional view of 7A in FIG. 7.

In a third embodiment, as shown in FIGS. 6, 7 and 7A, interlocking snap fasteners 52 are utilized to secure the waterproof rain cover 38 within the housing 34. A series of male snap fastener halves 54*a*, each having a groove, are disposed along the length of first end 42*a*. A series of female snap halves 54*b*, each having a circular lip which fit into the grooves of male snap halves 54*a*, are disposed along the length of second end 42*b*. As shown in FIG. 8*a*, each of the female snap halves 54*b*, have a circular lip 55*b* which fits into the groove 55*a* of male snap halves 54*a*. To remove the waterproof rain cover 38, the user unsnaps the series of male snap halves 54*a* along the first end 42*a* from series of female snap halves 54*b* along the second end 42*b* of the housing 34. Then the waterproof rain cover 38 can be pulled out from the housing 34 and disposed around the shoe 12.

Figure 8:
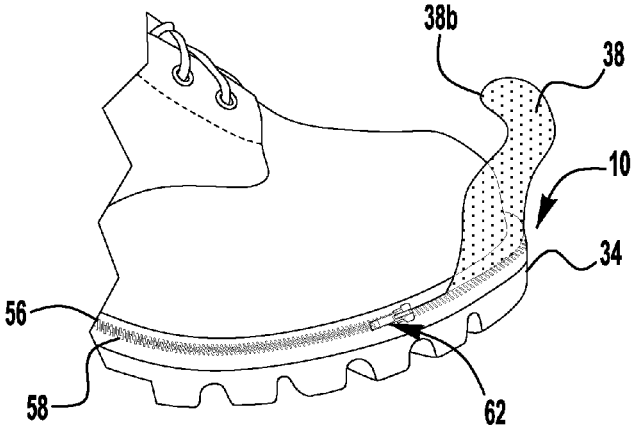
FIG. 8 is a partial side three dimensional view of a fourth embodiment of the footwear cover system in use with a shoe, in accordance with the present invention.

In a fourth embodiment, as seen in FIG. 8, a zipper 60 is utilized to secure the waterproof rain cover 38 within the housing 34. In this embodiment, there is an element of teeth 56 extending along the length of first end 42*a* and an identical element of teeth 58 extending along the length of second end 42*b*, that are joined together with a slider 62. To remove the waterproof rain cover 38, the user slides the slider 62 to release the elements of teeth 56 and 58 along the first and second ends 42*a* and 42*b* of the housing 34. Then the waterproof rain cover 38 can be pulled out from the housing 34 and disposed around the shoe 12.

To use the waterproof rain cover 38, one must first open the housing 34, which may be accomplished differently depending on the embodiment of the housing 34. In the first embodiment, seen in FIGS. 2 and 3, the user simply untucks the second end 42*b* from under the first end 42*a* and removes the waterproof rain cover 38 to place over the shoe 12. In the second embodiment, seen in FIGS. 4 and 5, the user separates the loop portion of VELCRO® material disposed along the length of the first end 42*a* from the hook portion of VELCRO® material disposed along the length of the second end 42*b* of the housing 34. In the third embodiment, seen in FIGS. 6, 7 and 7A, the user unsnaps the series of male snap halves 54*a* along the first end from series of female snap halves 54*b* along the second end 42*b* of the housing 34. In the fourth embodiment, seen in FIG. 8, the user slides the slider 50 to release the elements of teeth 56 and 58 along the first and second ends 42*a* and 42*b* of the housing 34.

Next, the user unrolls or unfolds the waterproof rain cover 38 from the housing 34, (note that the waterproof rain cover 38 may be attached and integral to the housing 34 or shoe 12 and will not come loose from the shoe), and wraps the waterproof rain cover around his/her shoe or leg. The waterproof rain cover 38 is then secured to the shoe 12 or leg with the elastic loop 64, as seen in FIG. 1, or any alternative method, such as a drawstring or cinching member. Now, fully employed, the waterproof rain cover 38 is ready for use and will prevent moisture, dirt, rocks, sand, stickers, and various other types of debris possibly encountered while walking from entering the shoe. After the waterproof rain cover 38 is no longer necessary, it is simply folded and/or rolled and inserted back into the housing 34.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A footwear cover system to prevent unwanted matter from entering a shoe of a wearer, comprising:

a shoe having an upper portion for surrounding at least part of a wearer's foot and a sole attached to the upper portion of the shoe;

the upper portion having a toe-receiving forepart section, a mid-foot receiving section, and a heel-receiving rear part section;

a housing surrounding the shoe and fastened to the shoe at an intersection of the sole and the upper portion;

a waterproof rain cover being stored and completely encased within the housing and adapted to being extended from the housing to enclose the upper portion; and a structure to secure the waterproof rain cover in place after it has enclosed the upper portion of the shoe; and wherein the housing has an outer surface which is secured at the intersection of the sole and the upper portion to enable an exterior back portion of the housing to be secured to the upper portion, and an exterior bottom portion of the housing to be secured to the sole of the shoe.

2. The footwear cover system of claim 1 wherein the housing is at least partially constructed of a stretchable material so that when the waterproof rain cover is stored and completely encased within the housing, the material of the cover is able to stretch or flex, whereby a working volume of the housing is increased to store and completely encase the rain cover.

3. The footwear cover system of claim 1 wherein the housing is constructed of a non-stretchable material, such that a volume of the housing is large enough to adequately store and completely encase the waterproof rain cover.

4. The footwear cover system of claim 1 wherein the exterior back portion and the exterior bottom portion of the housing are secured to the shoe with an adhesive.

5. The footwear cover system of claim 4 wherein the housing is constructed of a waterproof fabric with first and second ends; and the first and second ends are disposed with the first end covering the second end at a location opposite from where the exterior back portion of the housing is attached to the upper portion of the shoe.

6. The footwear cover system of claim 5 wherein the first end of the housing extends over the second end of the housing and the second end is tucked under the first end for securing and completely encasing the waterproof rain cover therein.

7. The footwear cover system of claim 5 wherein a loop portion of material is disposed along a length of the first end of the housing and is adapted to connect to a hook portion of material disposed along a length of the second end of the housing for securing the waterproof rain cover therein.

8. The footwear cover system of claim 5 wherein a series of male snap fastener halves are disposed along a length of the first end of the housing, and a series of female snap halves which fit into the male snap halves are disposed along a length of the second end of the housing for securing the waterproof rain cover therein.

9. The footwear cover system of claim 5 wherein an element of teeth extending along a length of the first end of the housing and an identical element of teeth extending along a length of the second end of the housing are joined together with a slider for securing the waterproof rain cover therein.

10. The footwear cover system of claim 1 wherein a first end of the waterproof rain cover is attached to an interior surface of the housing, and a second end of the waterproof rain cover is disposed within the housing after the cover has been rolled up for placement within the housing.

11. The footwear cover system of claim 5 wherein the first end of the housing remains disposed over the second end of the housing with the waterproof rain cover therebetween so that the housing does not have a tendency to fill with debris or water.

12. The footwear cover system of claim 1 wherein the structure to secure the waterproof rain cover in place is an elastic loop that is designed to secure the waterproof rain cover about the shoe, and wherein the elastic loop is attached to the waterproof rain cover.

13. A method for preventing unwanted matter from entering a shoe of a wearer, comprising;

providing a shoe with an upper portion for surrounding at least part of a wearer's foot and a sole attached to the upper portion of the shoe;

providing the upper portion with a toe-receiving forepart section, a mid-foot receiving section, and a heel-receiving rear part section;

fastening a housing to the shoe at an intersection of the sole and the upper portion;

storing a waterproof rain cover within the housing;

extending the waterproof rain cover from the housing, thereby enclosing the upper portion;

securing the waterproof rain cover in place after it has enclosed the upper portion of the shoe; and securing an outer surface of the housing at the intersection of the sole and the upper portion for securing an exterior back portion of the housing to the upper portion, and securing an exterior bottom portion of the housing to the sole of the shoe.

14. The method of claim 13 further including:

constructing the housing of a waterproof fabric with first and second ends; and disposing the first and second ends with the first end covering the second end at a location opposite from where the exterior back portion is attached to the upper portion of the shoe.

15. The method of claim 14 further including extending the first end over the second end and tucking the second end under the first end for securing the waterproof rain cover therein.

16. The method of claim 15 further including attaching a first end of the waterproof rain cover to an interior surface of the housing, and disposing a second end of the waterproof rain cover within the housing after the cover has been rolled up for placement within the housing.

17. The method of claim 13 further including attaching an elastic loop to the waterproof rain for securing the waterproof rain cover about the shoe.

* * * * *